US008245320B2

(12) United States Patent
Provost et al.

(10) Patent No.: US 8,245,320 B2
(45) Date of Patent: Aug. 21, 2012

(54) SAFETY HELMET ATTACHMENT AND METHOD FOR SHIELDING EYES

(75) Inventors: Jack Provost, Chatham, NJ (US); Dennis Jenkins, Oak Ridge, NJ (US); Brian Jenkins, Morristown, NJ (US); Jeffrey R. Burger, Bexley, OH (US); Chris S. Daniels, Columbus, OH (US); Kevin J. Vititoe, Columbus, OH (US)

(73) Assignees: Dennis Jenkins, Oak Ridge, NJ (US); Brian Jenkins, Morristown, NJ (US); Jack Provost, Chatham, NJ (US)

( * ) Notice: Subject to any disclaimer, the term of this patent is extended or adjusted under 35 U.S.C. 154(b) by 793 days.

(21) Appl. No.: 12/342,735

(22) Filed: Dec. 23, 2008

(65) Prior Publication Data

US 2010/0154093 A1 Jun. 24, 2010

(51) Int. Cl.
*A42B 3/22* (2006.01)

(52) U.S. Cl. ..... 2/13; 2/422; 2/12; 2/15; 2/426; 2/442; 2/443

(58) Field of Classification Search ..... 2/455, 410, 2/422, 15, 12–13, 426, 431, 434–435, 438, 2/442, 443, 448
See application file for complete search history.

(56) References Cited

U.S. PATENT DOCUMENTS

| | | | | |
|---|---|---|---|---|
| 264,574 | A | 9/1882 | Shone | |
| 857,838 | A | 6/1907 | Shaw | |
| 1,560,002 | A * | 11/1925 | Thompson | 2/10 |
| 2,496,969 | A * | 2/1950 | Wentworth | 351/62 |
| 4,322,138 | A | 3/1982 | Minart | |
| 4,442,551 | A | 4/1984 | Hellberg | |
| 4,479,738 | A | 10/1984 | Kubnick | |
| 4,639,950 | A | 2/1987 | Palmaer | |
| 4,856,109 | A | 8/1989 | Desy et al. | |
| 4,932,772 | A * | 6/1990 | Stanley et al. | 351/115 |
| 5,012,528 | A | 5/1991 | Pernicka et al. | |

(Continued)

FOREIGN PATENT DOCUMENTS

DE 2030546 12/1971

OTHER PUBLICATIONS

International Search Report with Written Opinion—PCT/US2009/061989.

*Primary Examiner* — Christopher Harmon
(74) *Attorney, Agent, or Firm* — Thomas L. Adams

(57) ABSTRACT

An eye shield attachment can be used in combination with a safety helmet. This helmet has a front brim continuous with a rim extending along each opposite side of the safety helmet to a pair of rim slots in the helmet's rim. The attachment has a pair of frames that can removably attach to the pair of rim slots in the helmet. The frames each have a fastening member that is lockable onto a corresponding one of the rim slots and adjustable to accommodate various depths in the rim slots. A support structure attached to the pair of frames extends along the rim toward the front brim. A front lens and corrective glasses may be attached to the support structure. A pliable bead may be attached to the front of the support structure and extend rearwardly to engage a wearer's forehead.

35 Claims, 7 Drawing Sheets

U.S. PATENT DOCUMENTS 5,052,054 A * 10/1991 Birum ..... 2/10
5,373,583 A * 12/1994 Birum ..... 2/10
5,533,207 A 7/1996 Diaz
5,890,233 A 4/1999 Kaffka
5,926,854 A 7/1999 Grilliot et al.
5,940,891 A 8/1999 Lane
5,966,738 A 10/1999 Wang Lee
6,026,518 A * 2/2000 Brown ..... 2/439
6,134,719 A 10/2000 Kuo
6,185,739 B1 2/2001 Verkic et al.
6,247,177 B1 * 6/2001 Hayes ..... 2/12
6,397,396 B1 * 6/2002 Vibert ..... 2/209.13
6,490,729 B1 12/2002 Dondero
6,491,390 B1 12/2002 Provost
6,618,907 B2 * 9/2003 Morris ..... 24/3.3
6,637,074 B1 * 10/2003 Morris ..... 24/3.12
6,892,393 B1 * 5/2005 Provost et al. ..... 2/10
6,959,989 B2 11/2005 Holm
7,229,172 B2 6/2007 Presswood, Jr. et al.
7,703,153 B2 * 4/2010 de Taboada ..... 2/422
7,908,668 B2 * 3/2011 Folkesson ..... 2/6.3
2002/0069489 A1 6/2002 Morris
2005/0078273 A1 4/2005 Holm
2006/0158609 A1 7/2006 Heil
2006/0236438 A1 10/2006 Rogers et al.
2009/0056000 A1 * 3/2009 de Taboada ..... 2/422
2009/0235437 A1 * 9/2009 Springer et al. ..... 2/422
2011/0072564 A1 * 3/2011 Krauter ..... 2/422

* cited by examiner

SAFETY HELMET ATTACHMENT AND METHOD FOR SHIELDING EYES

BACKGROUND OF THE INVENTION

1. Field of the Invention

The present invention relates to devices and methods for shielding the eyes, and in particular, to eye shields designed to attach to a safety helmet.

2. Description of Related Art

Construction workers and emergency personnel often wear safety helmets under varying conditions and for extended periods of time. The users of these helmets may also wear safety glasses for avoiding eye injury, or ordinary sunglasses to deal with bright light and glare. When doing close-up work or when working in a relatively dark environment, safety helmet users will often temporarily remove their glasses. The temporarily removed glasses are then often lost or damaged. In some cases a user may wish to glance at a bright scene or a dark scene and therefore may wish to briefly don or remove sunglasses, but this process is inconvenient and for efficiency's sake may be performed by temporarily lifting or removing the safety helmet. Obviously, helmet removal is to be avoided for safety reasons.

The safety helmets known as hardhats typically have right and left slots along the lower rim of the helmet for holding accessories such as ear muffs. See for example U.S. Pat. No. 4,639,950. In FIGS. 6 and 7 of U.S. Pat. No. 5,012,528 a visor 96 is attached through pivot 92 to arm 88, which connects through pivot 92 to a connecting member 86 that is attached to side slots on a hard hat from above. When not needed, visor 96 swings upwardly to a position above the brim of the hard hat. See also U.S. Pat. No. 4,479,738.

In U.S. Pat. No. 5,966,738 a safety visor is attached to an arm 21 that is pivotally connected to blocks 22 that are designed to snap into the side slots on a hard hat from above. The visor is positioned in front of the brim when in use. When no longer needed, the visor swings into a position above the brim. See also U.S. Pat. No. 4,442,551.

In U.S. Pat. No. 6,892,393 a pair of hubs each have tongs that snap into rim slots on the sides of a conventional safety helmet. A pair of telescopic temples project from these hubs so that their longitudinal and angular orientation can be adjusted. A lens is rotatably attached to the ends of the temples in order to flip up from a lower position to a raised position. The pivoting is arranged to allow the lens to flip up and still remain subjacent to the brim of the helmet. Thus, the eye shield attachment can be conveniently placed on a safety helmet and adjusted so that the lens is located at a position that is in front of the user's eyes and spaced far enough away for comfort.

See also U.S. Pat. No. 5,533,207 (eye shade is bolted or screwed to bill of a hard hat); U.S. Pat. No. 5,926,854 (face shield hinged to a bracket that is attached to the side of a protective helmet); U.S. Pat. No. 6,490,729 (goggles straps can be pushed onto quick fasteners that attach to the edge of a safety helmet); and U.S. Pat. No. 6,959,989 (top center edge of safety glasses clip into connector on front of helmet); as well as U.S. Patent Application Publication No. U.S. 2002/0069489 (pair of wings clip into the side slots of a hard hat to provide a nook for keeping sunglasses handy).

Designing an accessory that can attach to a safety helmet is complicated by the fact that rim slots vary from helmet to helmet. While one may make a clip that is small enough to fit into the smallest rim slot, this clip will be loose in larger rim slots. Also, a known clip has a trio of tongs, the center one having a step or shoulder that deflects as it passes through the rim slot before snapping over the upper edge of the slot. While one may make this tong long enough to accommodate the largest rim slot, again excessive play will occur for smaller slots. Moreover, looseness or play may result in the accessory accidentally disconnecting from the rim slots. In fact, accidental disconnection from a rim slot is a significant concern even when a clip is designed for the dimensions of a specific rim slot.

See U.S. Pat. No. 6,491,390 (a frame clipped to the bill of a cap pivotally supports a lens); U.S. Pat. No. 6,134,719 (helmet windshield attached to the helmet by pivots 11); U.S. Pat. No. 5,890,233 (alternative visors pivotally connected to the side of a light sports helmet); U.S. Pat. No. 4,856,109; and U.S. Pat. No. 6,185,739. See also, U.S. Pat. Nos. 264,574; 857,838; 4,322,138; 5,012,528; 5,940,891; 6,618,907; and 7,229,172, as well as U.S. Patent Application Publication Nos. 2006/0158609 and 2006/0236438.

SUMMARY OF THE INVENTION

In accordance with the illustrative embodiments demonstrating features and advantages of the present invention, there is provided an eye shield attachment for use in combination with a safety helmet. The helmet has a front brim continuous with a rim extending along each opposite side of the safety helmet to a pair of rim slots in the rim of the safety helmet. The eye shield attachment includes a pair of frames adapted to removably attach to the pair of rim slots in the helmet. The frames each have a fastening member that is lockable onto a corresponding one of the rim slots and adjustable to accommodate various depths in the rim slots. Also included is a support structure that is attached to the pair of frames and adapted to extend along the rim toward the front brim. The eye shield attachment also has a lens attached to the support structure.

In accordance with another aspect of the invention, there is provided an eye shield attachment for use in combination with the foregoing safety helmet. The eye shield attachment includes a support structure adapted to removably attach to the pair of rim slots in the helmet and extend along the rim toward the front brim. Also includes is a lens attached to the support structure. The eye shield attachment also includes corrective glasses attached to the support structure behind the lens.

In accordance with yet another aspect of the invention, there is provided an eye shield attachment for use in combination with the foregoing safety helmet. The eye shield attachment includes a support structure adapted to removably attach to the pair of rim slots in the helmet and extend along the rim toward the front brim. The support structure has a front section. Also included is a lens attached to the support structure. The attachment also includes a pliable bead attached to the front section and extending rearwardly to engage a wearer's forehead.

In accordance with still yet another aspect of the invention, a method is provided for attaching an eye shield to the foregoing safety helmet. The method includes the step of attaching to the pair of rim slots a support structure that extends along the rim to the front brim using a pair of fastening members. The support structure is used to support the eye shield. Another step is adjusting the fastening members to accommodate various depths in the rim slots and locking the fastening members in place.

By employing apparatus and methods of the foregoing type an improved accessory is achieved that can be readily attached to the rim slots of a safety helmet. In a disclosed embodiment a right and left frame each has a pair of tongs.

Each tong has an arm cantilevered at an acute angle outwardly from the distal tip of an upright post. Accordingly, the arms of the tongs can compress as they are inserted into a rim slot, thereby making for a snug fit and reducing play. In this embodiment a slotted strap projects from the frame between the tongs and through the rim slot. This slotted strap folds back over the outside of the rim slot so that one of the strap slots may be attached to an external lug on the frame. Accordingly, the strap ties the frame to the rim slot to prevent accidental disconnection from the safety helmet.

In this disclosed embodiment a structure that supports a flip up lens has a pair of temple sections that slide through the channels on a pair of rotors that are rotatably mounted in the two frames. The rotors can be turned to change the angle of elevation of the temples and thus the height of the lens. Also, the temple sections can be slid through the channels in the rotors to change the spacing of the lens from the face. Detents are provided so that the temples can maintain a desired extension and angle of elevation. Also in this disclosed embodiment, the rear tips of the temples have a keyhole-shaped notch for gripping a cord or lanyard that holds another accessory such as ear protectors.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
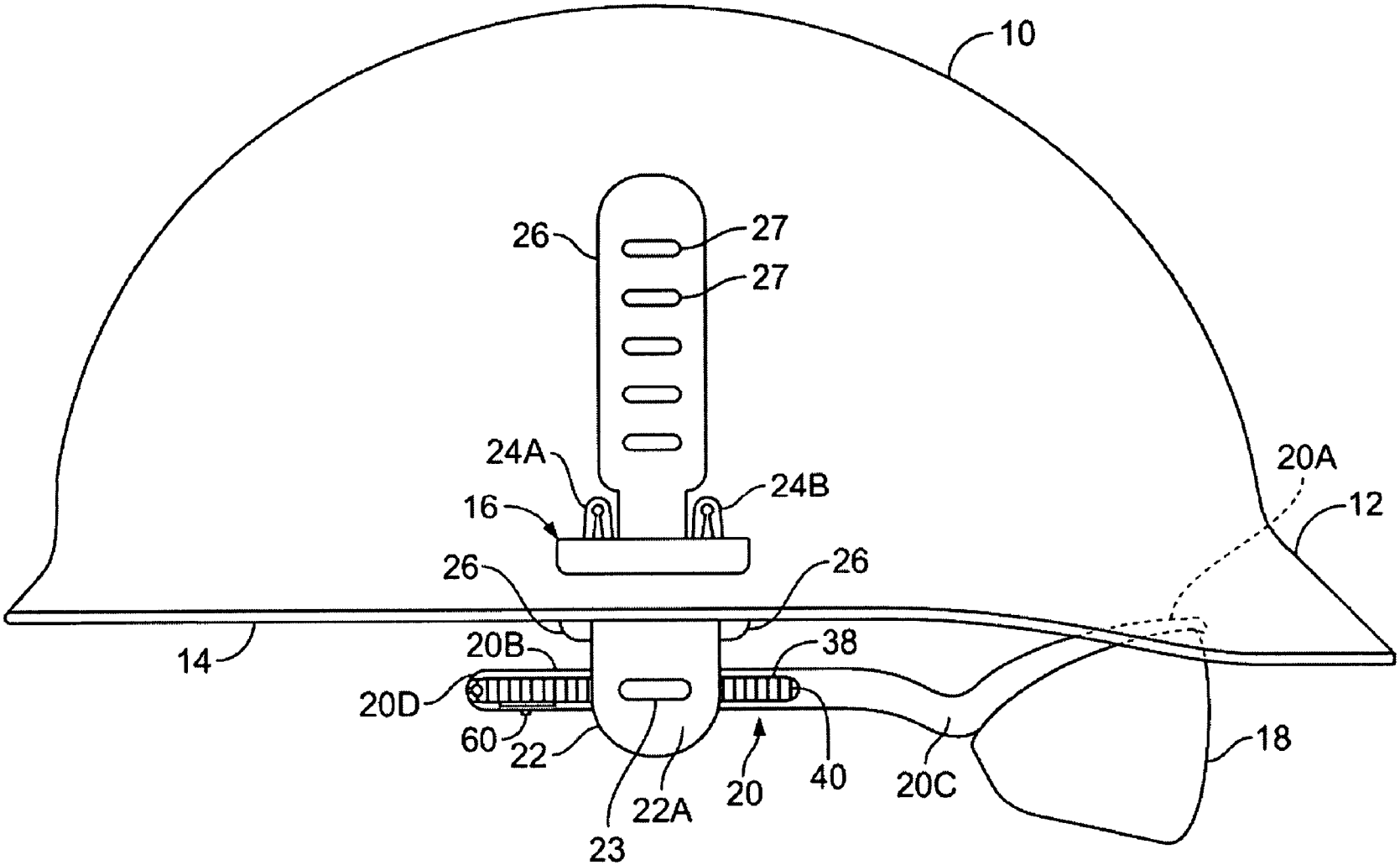
FIG. 1 is a perspective view of a safety helmet with an eye shield attachment in accordance with principles of the present invention.

Referring to FIG. 1, a safety helmet 10 is shown as a hard hat, although other safety helmets may be employed having different shapes, including the shape associated with the helmets worn by firefighters. The front brim 12 of helmet 10 is shown as a somewhat elongated bill, although embodiments are contemplated where the front brim of the helmet will simply be an edge without any substantial forward projection. Therefore, as used herein, the term brim does not necessarily imply an outwardly projecting element.

The rim 14 of helmet 10 extends continuously from front brim 12. The helmet 10 has on its right and left side along rim 14 a conventional rim slot 16 in the form of a four-sided rectangular passage open at its upper and lower ends.

An eye shield attachment is shown mounted in rim slot 16. In particular, a lens 18 is shown mounted distally, that is, on the distal end of support structure 20. As explained further hereinafter lens 18 (also referred to as an eye shield) is pivoted and is shown in this Figure in its lowered position. In this embodiment support structure 20 has an arched front section 20A that is integral with right and left sections 20B. Arch 20A connects to side sections 20B through a V-shaped transition or valley 20C. It will be appreciated that in some embodiments structure 20 may being composed of discrete elements that are attached together.

Each side section 20B is pivotally and slidably attached to a frame 22. A rack of ridges or teeth 40 are located along groove 38 of section 20B. It will be appreciated that an identical frame is attached to the other rim slot on the opposite side of helmet 10.

A pair of tongs 24A and 24B upwardly project from frame 22 and are shown reaching out of the top of rim slot 16. Frame 22 and the tongs 24A and 24B will be a single, integrally molded plastic item, although other embodiments may employ multiple components made of various materials.

A relatively long fastening member 26 is attached to frame 22 and upwardly projects between tongs 24A and 24B and through rim slot 16. Although the bulk frame 22 is shown located below rim slots 16 in other embodiments the frame may be located mostly above and, in general, the direction of fastening member 26 is referred to as the extension direction. Member 26 is shown as a flexible plastic band with a narrow proximal section leading to a wider section with five evenly spaced slots 27. Slots 27 are designed to snap over the head of lug 23 which has a T-shaped cross-section (i.e., a mushroom-like shape).

Figure 2:
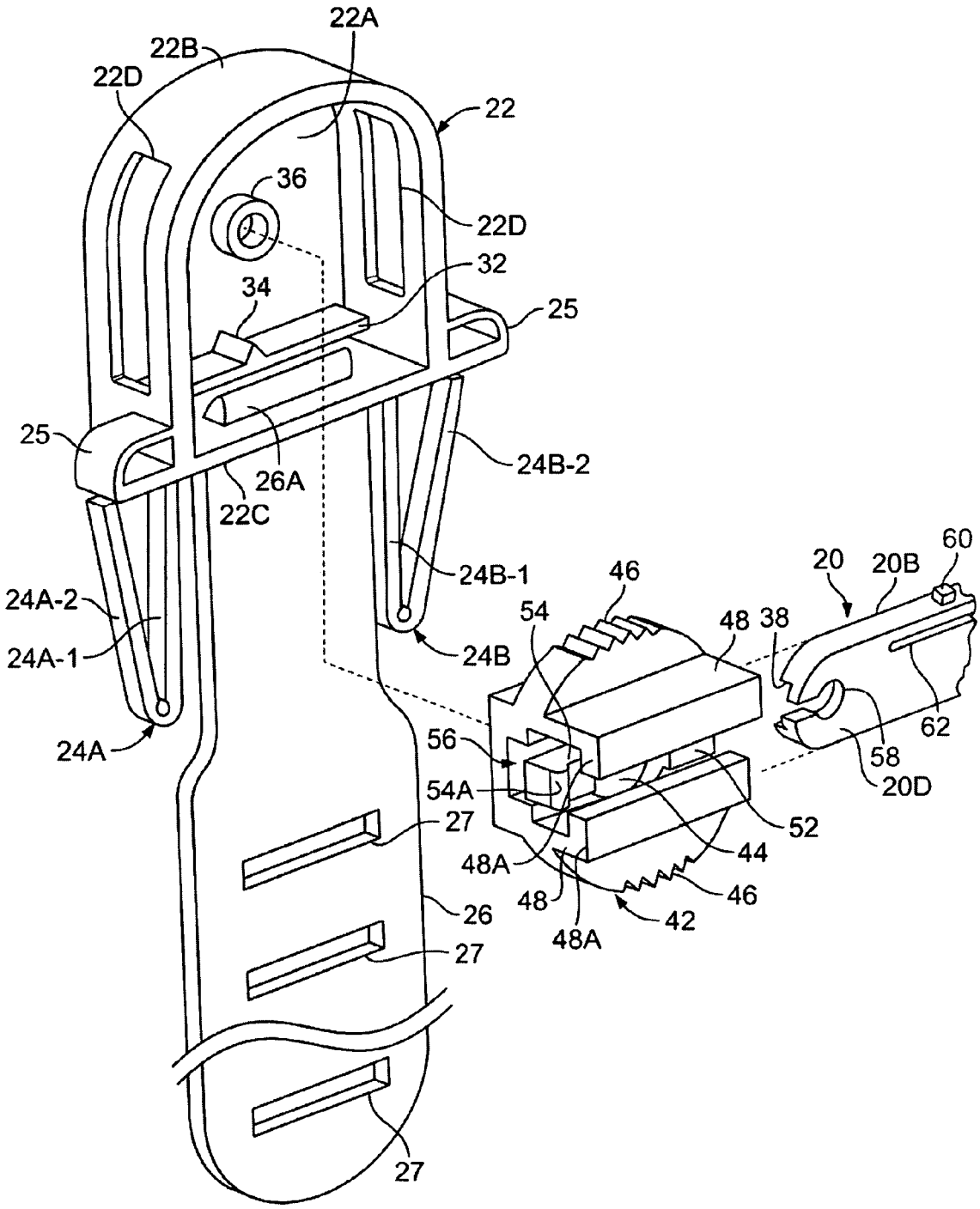
FIG. 2 is an exploded, perspective view of one of the side frames of the attachment of FIG. 2.

Referring to FIG. 2, previously mentioned frame 22 has a panel 22A surrounded by a straight wall 22C and an arched wall 22B, the latter wall having an opposing pair of side openings 22D. Outwardly extending in opposite directions from the two ends of wall 22B are a pair of cup-shaped ears 25 that are open on the inside.

Previously mentioned tong 24A has a tapered upright post 24A-1 that extends from wall 22C and integrally connects at its distal end to non-tapered, cantilever 24A-2, which extends outwardly at an acute angle of about 10° from post 24A-1 to provide an outside edge that is distally converging. The inside crook between elements 24A-1 and 24A-2 has a cylindrical relief. Tong 24B and its elements 24B-1 and 24B-2 are on the opposite end of wall 22C and constitute the mirror image of tong 24A. The outside edges of cantilevers 24A-2 and 24B-2 tend to center frame 22 without locking onto a rim slot (rim slot 16 of FIG. 1). Accordingly, at least 90% of the length of outside edges of cantilevers 24A-2 and 24B-2 penetrate at least penetrate the rim slot. Thus, the free ends of cantilevers 24A-2 and 24B-2 do not penetrate the rim slot and snap outwardly to lock in place.

Shelf 32 connects between opposing sides of wall 22B, and is spaced slightly from the inside of panel 22A to allow deflection relative thereto. Elevational detent 34 projects inwardly from the center of shelf 32 and is in the form of a triangular prism. A cylindrical collar 36 projects from the inside face of panel 22A. Previously mentioned fastening member 26 is shown with a tang 26A that is tapered like an arrowhead in order to snap into a mating slot in wall 22C.

Figure 3:
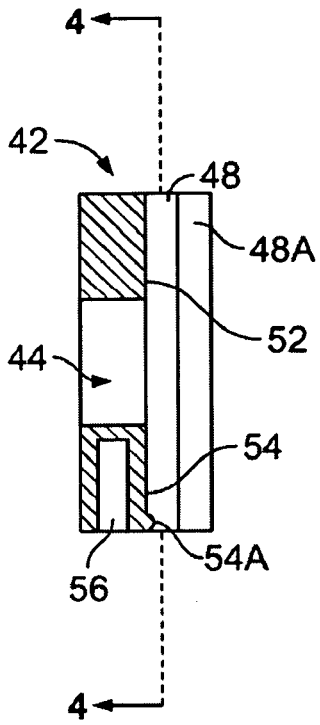
FIG. 3 is a cross-sectional view taken through a plane containing the axis of the rotor of FIG. 2 and parallel to its walls.
Figure 4:
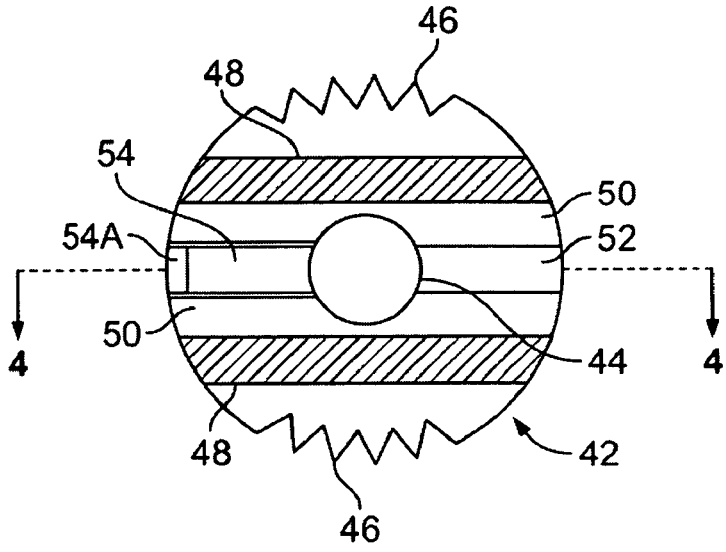
FIG. 4 is a cross-sectional view taken along line 4-4 of FIG. 3.

Referring to FIGS. 2-4, rotor 42 is shown as a wheel-like structure with a concentric hole 44 and two sets of peripheral teeth 46 in two diametrically opposed 45° sectors. Projecting axially to straddle hole 44 and form a channel are parallel walls 48, whose outer edges have inwardly turned, opposing lips 48A.

A pair of parallel grooves 50 run along the inside edges of walls 48, leaving a ridge 52 that is diametrically aligned with hole 44. Diametrically aligned on the opposite side of hole 44 is another ridge formed into a cantilevered detent 54 by virtue of the undercut 56. Detent 54 (also referred to as a proximity detent) can flex to allow its axially projecting, distal tooth 54A to move in and out.

Figure 5:
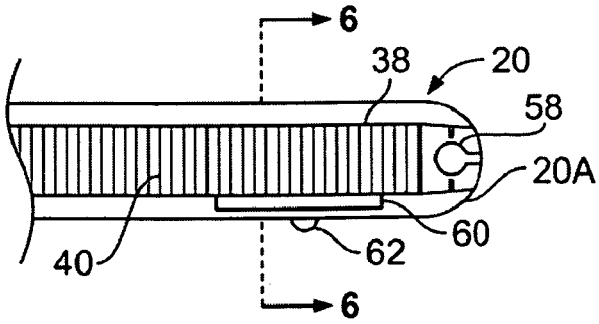
FIG. 5 is a detailed view of the distal end of the side temple section of FIG. 1.
Figure 6:
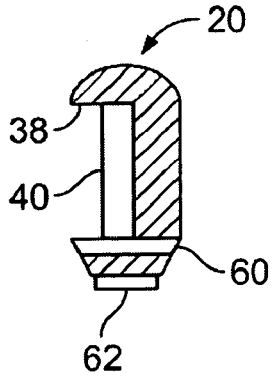
FIG. 6 is a cross-sectional view taken along line 6-6 of FIG. 5.

Referring to FIGS. 2, 5 and 6, groove 38 of previously mentioned side section 20B extends to distal tip 20D and contains a plurality of teeth 40. The distal end of groove 38 has a keyhole-shaped opening 58, sized to hold a cord or lanyard that connects to an accessory such as a hearing protection device.

Rotor 42 is rotatably mounted against panel 22A on frame 22 with collar 36 inserted through rotor hole 44. Then section 20B can be inserted through one of the openings 22D and into the channel between walls 48 of rotor 42.

FIG. 2 indicates rotor 42 mounted on collar 36 with the proximity detent 54 to the left, in this view. FIG. 2 also suggests section 20B being inserted from the right. This arrangement would be appropriate for attachment to a right temple section. For attachment to a left temple section, rotor 42 may be rotated 180° and the temple section 20B inserted through the other opening 22D that is shown on the left in FIG. 2. In either event, detent 34 will fall among the teeth 46 on one side or the other of rotor 42. Therefore, the rotor will tend to stay in a given angular position unless enough torque is applied to deflect shelf 32, drive detent 34 outwardly, and allow the detent to skip between teeth 46.

Temple section 20B has on its edge a stop 60 in the form of a transverse nub located over a hollow 62, which can collapse under pressure in order to allow retraction of stop 60. This retraction of stop 60 allows temple section 20B to slide into and out of the channel between walls 48 of rotor 42. When stop 60 has entered and passed through the channel formed by walls 48, the stop can be released to prevent accidental removal of the temple from the channel. Groove 38 of temple section 20B can then slide over ridge 52, provided enough longitudinal force is applied to depress detent tooth 54A, allowing it to ratchet over teeth 40 of temple section 20B.

Figure 7:
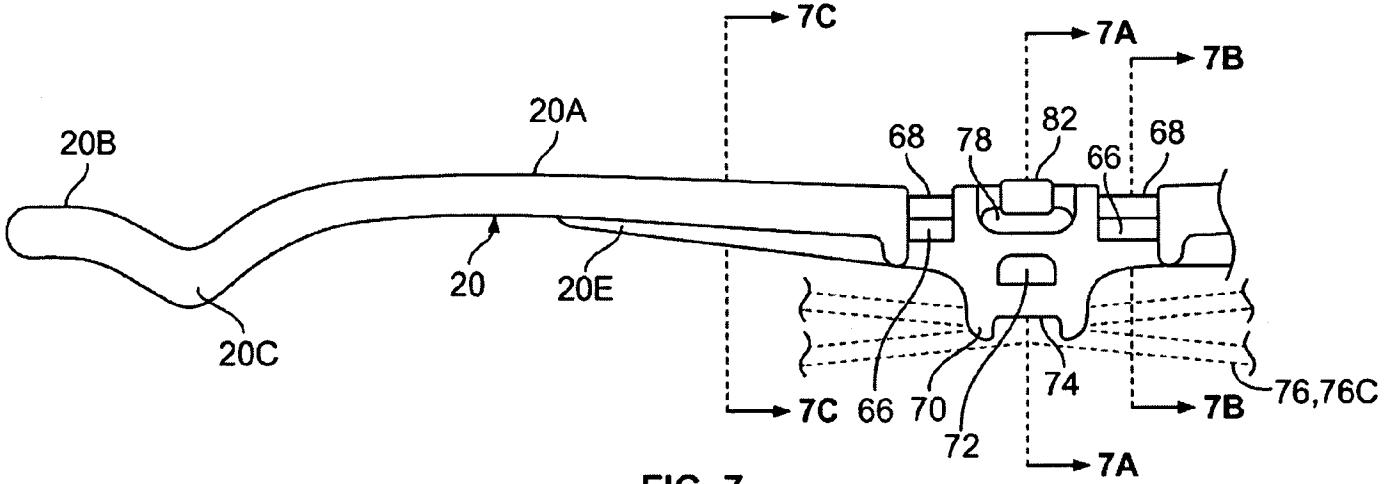
FIG. 7 is a front elevational view of the support structure of FIG. 1 with a right portion broken away for illustrative purposes.
Figure 7C:
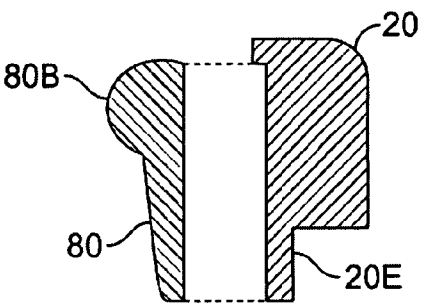
FIG. 7C is a cross-sectional view of the support structure of FIG. 7 taken along line 7C-7C and showing a pliable bead about to be installed thereon.
Figure 7B:
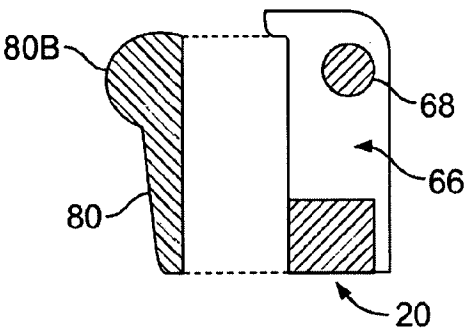
FIG. 7B is a cross-sectional view of the support structure of FIG. 7 taken along line 7B-7B and showing a pliable bead about to be installed thereon.
Figure 8:
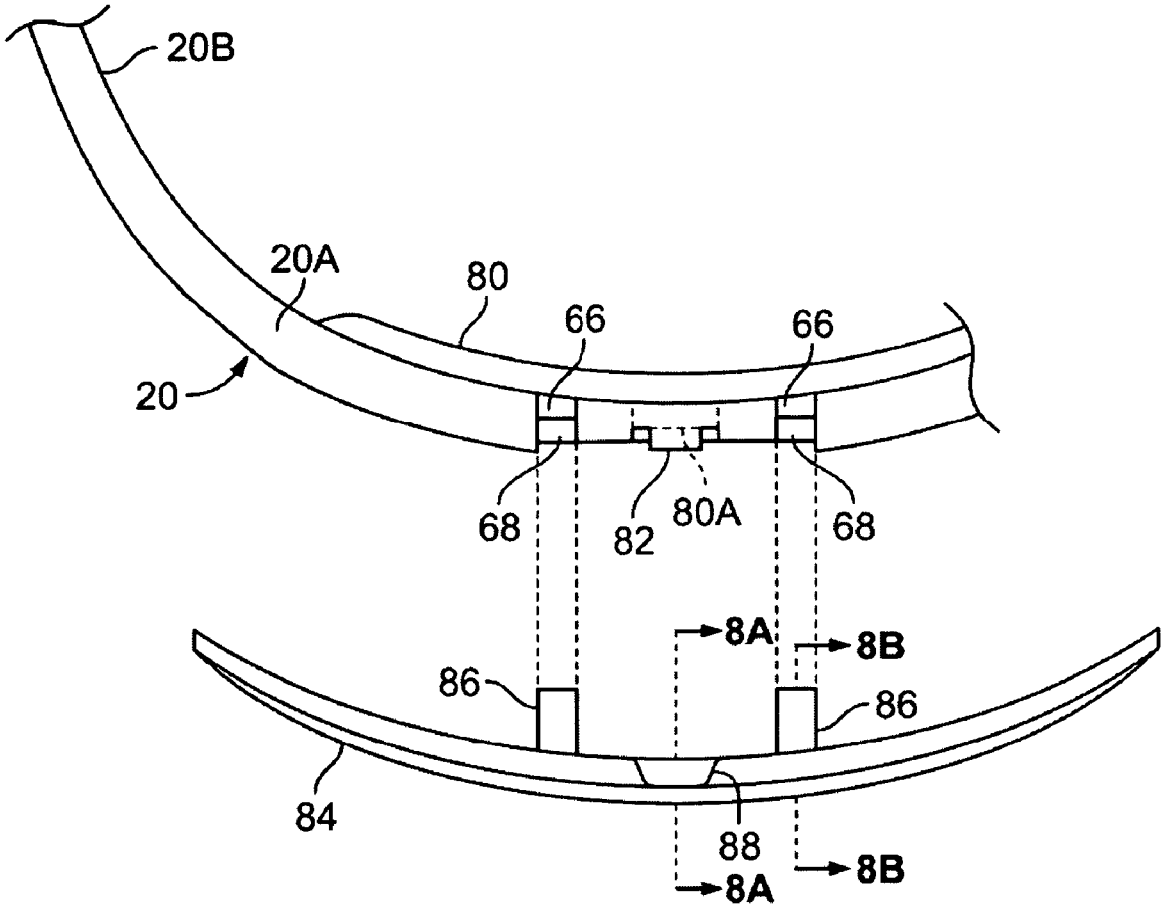
FIG. 8 is an exploded, top plan view of the support structure of FIG. 1 with a right portion broken away for illustrative purposes.
Figure 9:
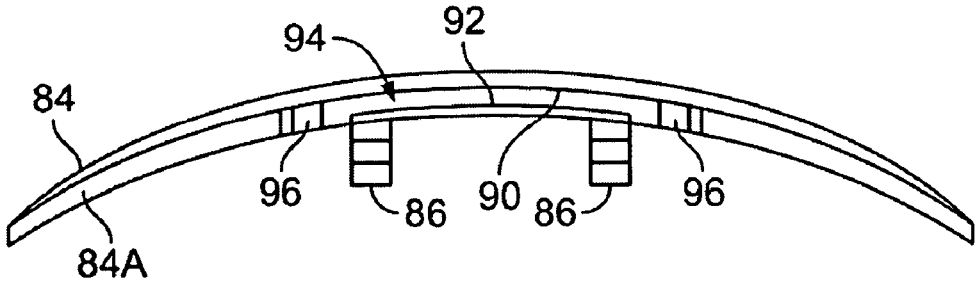
FIG. 9 is a bottom view of the pivoting lens holder of FIG. 8.
Figure 8A:
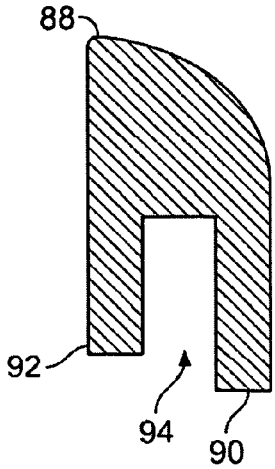
FIG. 8A is a cross-sectional view of the support structure of FIG. 8 taken along line 8A-8A.
Figure 8B:
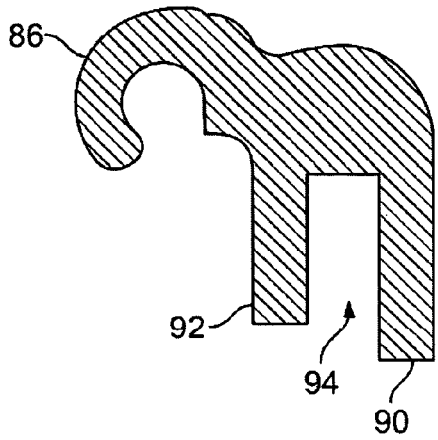
FIG. 8B is a cross-sectional view of the support structure of FIG. 8 taken along line 8B-8B.

Referring to FIGS. 7-9, front section 20A has near its center a pair of ventral fins 20E leading to a pair of notches 66 each spanned by a cylindrical shaft 68. A downwardly directed, notched tongue 70 (also referred to as a land region) located at the center of section 20A has an upper aperture 72 exposing a shaft 74. Corrective glasses 76 (shown in phantom) can clip onto shaft 74 in a manner to be described presently.

A pliable bead 80 made of a soft elastomeric material is glued to the back face of front section 20A and is approximately coterminous with the distal ends of ventral fins 20E. Bead 80 is absent from FIG. 7 to simplify the illustration. Bead 80 has a plug 80A that is press fitted into socket 78 (FIGS. 7 and 7A) located just above previously mentioned aperture 72. A frontwardly projecting rectangular boss 82 located above socket 78 (and slightly overlapping the socket) is straddled on the right and left with a pair of notches.

Referring to FIGS. 8-9, a crescent-shaped lens holder 84 has a central, tapered projection 88 located between a pair of C-shaped, rear clips 86 that open downwardly. Clips 86 can snap onto and rotate upon previously mentioned shafts 68. As the back of projection 88 rotates between the front and the top face of boss 82, the projection 88 can climb over the upper front corner of boss 82, thereby passing between two detent positions; namely, a raised and a lowered position for holder 84.

As shown in FIG. 9 holder 84 has a front wall 90 running approximately the entire length of the holder essentially at right angles to overhang 84A. A relatively short inside wall 92 faces front wall 92 to form a lens-holding channel 94 bordered on opposite ends by undercut stubs 96, which are integral with wall 90 and overhang 84A.

Figure 10:
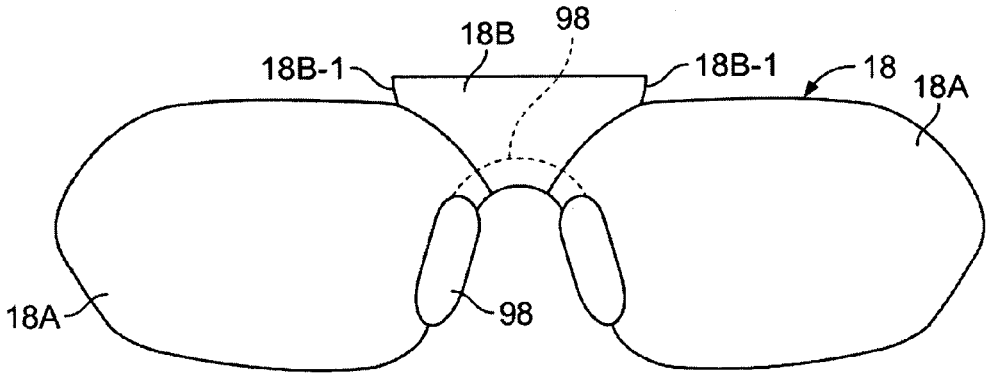
FIG. 10 is a front view of the lens of FIG. 1.

Referring to FIG. 10, lens 18 has bowed, right and left sections 18A that together curve through about 160°. Sections 18A are joined by a relatively flat, integral bridge 18B with an upper pair of undercut corners 18B-1. A relatively soft nosepiece 98 is placed between the sections 18A and under bridge 18B.

Figure 7A:
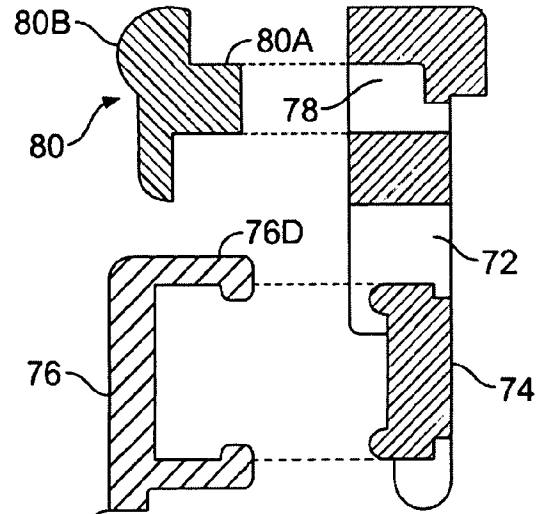
FIG. 7A is a cross-sectional view of the support structure of FIG. 7 taken along line 7A-7A and showing a pliable bead and corrective glasses about to be installed thereon.
Figure 11:
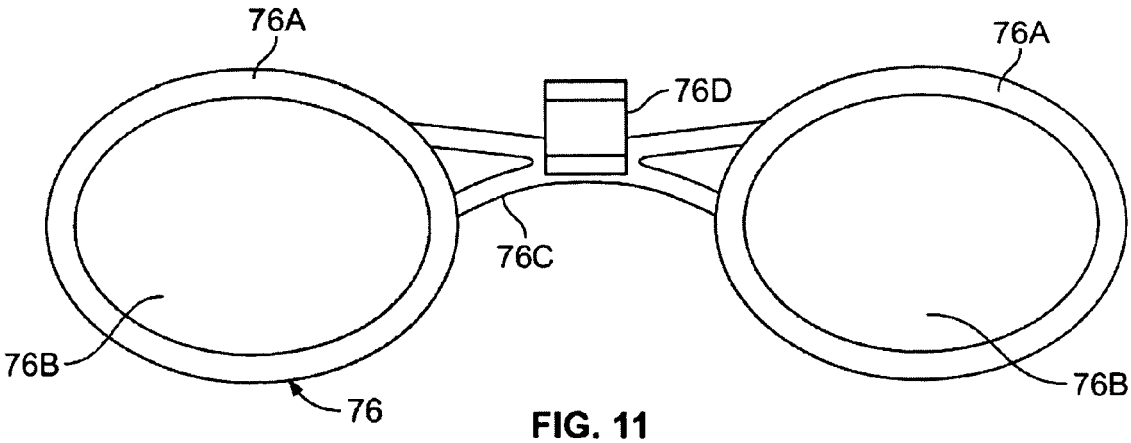
FIG. 11 is a front view of corrective glasses that can snap onto the support structure as shown in phantom in FIG. 7.
Figure 12:
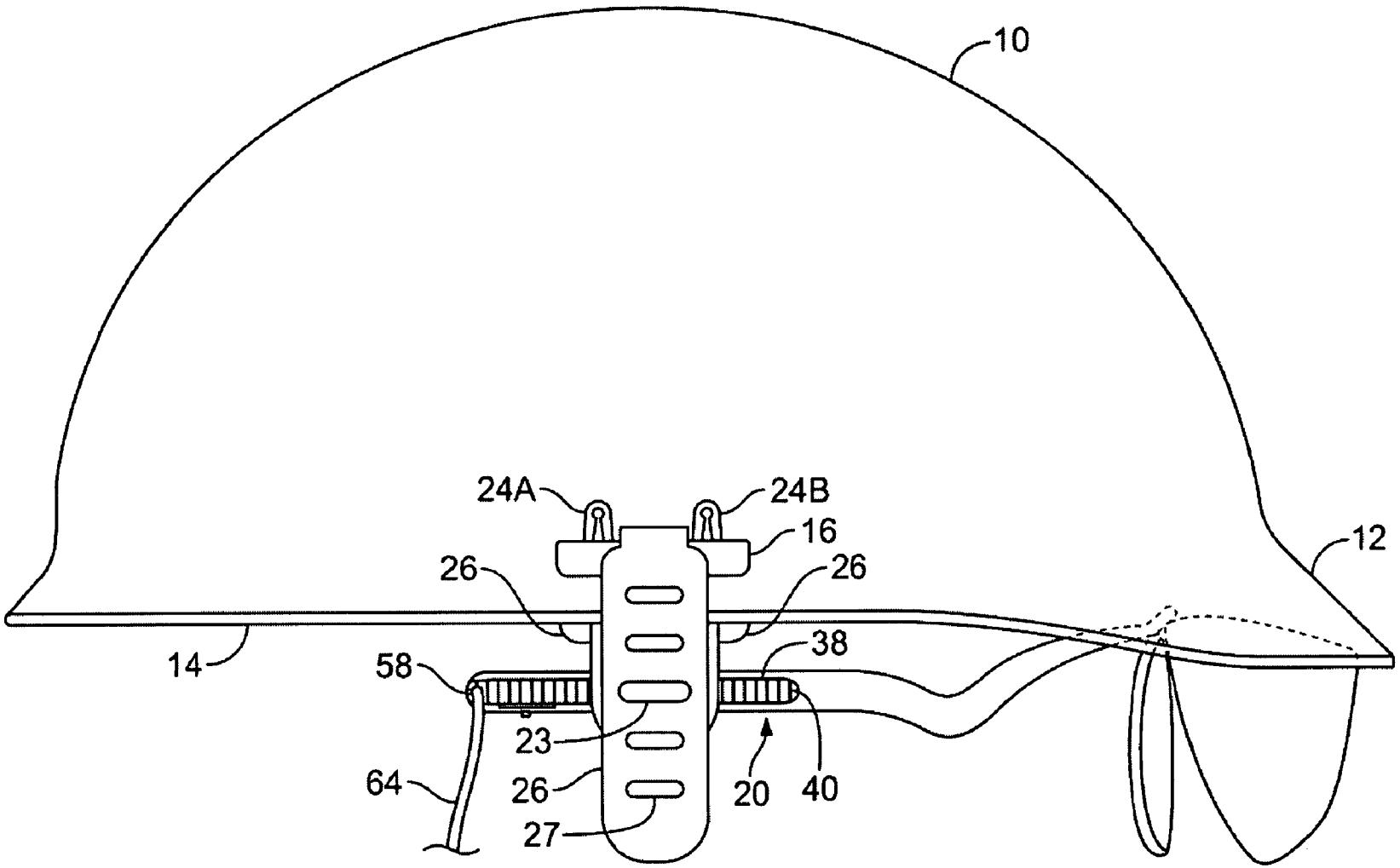
FIG. 12 is a perspective view of the safety helmet of FIG. 1 showing the eye shield attachment fastened with a fastening member and the lens raised.

Referring to FIGS. 11 and 7A, corrective glasses 76 have a pair of rings 76A encompassing a pair of prescription lenses 76B. Rings 76A are joined by X-shaped bridge 76C, which is integrally connected to a C-shaped clip 76D.

To facilitate an understanding of the principles associated with the foregoing apparatus, its operation will be briefly described. A user may select any one of the conventional safety helmets having rim slots similar to slot 16 of FIG. 1. The foregoing eye shield attachment may be installed by grasping one of the frames 22 and inserting the tongs 24A and 24B, and fastening strap 26 from below into the rim slot 16. A frame on the other side will be likewise installed.

The tongs 24A and 24B will guide and center the assembly. In particular, arms 24A-2 and 24B-2 will deflect inwardly to accommodate the clearance inside rim slot 16. Moreover, this feature will allow tongs 24A and 24B remove the play for different sizes of rim slots.

When fully inserted, shoulder 25 will press against the underside of rim slot 16. At this time, fastening strap 26 can be folded down to the position shown in FIG. 7 and an appropriate one of the slots 27 can be snapped over the lug 23. This arrangement will accommodate rim slots of different depths. Thus, for relatively deep (shallow) rim slots a distal (proximal) one of the slots will be chosen. Moreover, fastening strap 26 will positively lock frame 22 in place, preventing accidental disconnection thereof.

Lanyard or cord 64 is shown attached to previously mentioned notch 58. Cord 64 may terminate in a knot that keeps the court in the notch. Alternatively, cord 64 can have a loop that passes through the notch 58.

As previously described, temple section 20B is mounted inside rotor 42 (FIG. 2) and is allowed to slide longitudinally and to rotate and thereby change the angle of elevation. When temple section 20B slides longitudinally lens 18 can be brought closer or further from the wearer's face. When temple section 20B is rotated the lens can be moved higher or lower relative to helmet 10 and the wearer's face. For the reasons previously described, temple section 20B will tend to keep this angular and longitudinal orientation unless sufficient force is applied to overcome the previously mentioned detents, namely, detents 54 and 34 of FIG. 2. Also, groove 38 terminates at distal end 38A (FIG. 7). Accordingly, end 38A acts as a stop that restricts inward (dorsal) movement of lens 18 to limit facial impact with the lens.

Accordingly, the user may position lens 18 to avoid pressure on the face or nose and thereby increase the wearing comfort. Also, support structure 20 can be adjusted so projection 80B on bead 80 lightly presses against the wearer's forehead so that sweat is diverted away from the eyes.

In addition, the user may elevationally adjust lens 18 by adjusting the angle of elevation of temples 20. This adjustment allows the user to vertically center lens 18 relative to the users eyes, as well as provide an appropriate clearance from the underside of front brim 12.

The temple section 20B can be extended to provide clearance for eyeglasses that the user may be wearing. However, instead of using conventional eyeglasses, the wearer can use the corrective glasses 76 as shown in FIG. 11. These glasses can be fitted with prescription lenses 76B tailored to the wearer's vision. In that case, the branches of clip 76D can be snapped around bar 74 (FIG. 7). Accordingly, the corrective glasses 76 will remain in position whether or not shielding lenses 18 are raised or lowered.

When the user is wearing the helmet 10 lens 18 will typically be positioned as shown in FIG. 1 providing protection for the user's eyes and, if desired, shading. If there is some need to get the lens 18 away from the user's eyes, the lens 18 can be quickly flipped up to the raised position. This process can be performed without removing helmet 10.

When flip-up lens 18 is raised, tapered projection 88 (FIG. 8) slides from the front face of boss 82 (FIG. 7), traversing the upper front corner of the boss and eventually reaching the upper face of the boss. When the lens 18 is lowered projection 88 traverses boss 82 in the opposite direction. This traversal across the upper front corner of boss 82 effectively detains lens holder 84 and thus lens 18 in either a raised or a lowered position.

Lens 18 may be replaced either when worn or when the wearer wants to change the lens to provide a different type of shaded or tinted lens. Because corners 18B-1 (FIG. 10) as well as locking studs 96 (FIG. 9) have complementary undercuts, bridge 18B can snap out of channel 94 away from studs 96. A replacement lens 18 can be attached by aligning its bridge 18B with channel 94 and pressing inwardly until the undercut corners 18B-1 snap into position past the undercut studs 96.

It is appreciated that various modifications may be implemented with respect to the above described, preferred embodiments. Instead of releasably attaching one of the slots of the flexible strap to a lug, an attachment can be made by a ball and socket joint, a hasp, a magnetic latch, a hook and staple joint, hook and loop fasteners, etc. Furthermore, instead of a V-shaped tong, some embodiment may have a spring biased bar, a flexible bowed leg, an adjustable set screw, etc. Also, the outline, shape, and curvature of the lens can be adjusted to accommodate various helmets, users' head sizes, personal preferences, fashion considerations, etc. In some cases, the lens will be given a curvature to act as prescription lenses that correct the users sight deficiencies. Furthermore, the pivot point of the lens can be repositioned to alter the height reached by the lens when swung into the raised position. Moreover, some embodiments may have a brace spanning the distal ends of the side frames and the lens may be pivotally mounted on that brace. In some embodiments a ball will be formed at the distal end of the side frames that will snap into sockets on the lens or vice versa. In still other embodiments, the ball joint may be replaced with a simple hinge, including a live hinge. Instead of sliding adjustment of the temple through a frame, some temples can be telescopically adjustable to adjust the horizontal spacing. In addition the rotor supporting the temple can have any one of a variety of shapes and its temple-supporting channel can be a tunnel. Instead of being slidably mounted in a channel, the temple can have a C-shaped cross-section that slidably fits on a male fitting that allows the temple to slide and rotate. Also, in some embodiments the temples may be made of a flexible material that can be arbitrarily bent to adjust the position of the lens. Furthermore, instead of a plurality of tongs, the eye shield attachment may have a removable component that is inserted down through the rim slot to attach to structure located below the rim of the helmet that ultimately supports the lens.

Obviously, many modifications and variations of the present invention are possible in light of the above teachings. It is therefore to be understood that within the scope of the appended claims, the invention may be practiced otherwise than as specifically described.

The invention claimed is:

1. An eye shield attachment for use in combination with a safety helmet having a front brim continuous with a rim extending along each opposite side of said safety helmet to a pair of rim slots in the rim of said safety helmet, said rim slots each having a passage open at either end, said eye shield attachment comprising:

a pair of frames adapted to removably attach to said pair of rim slots in said helmet, said pair of frames each having a fastening member that is (a) arranged to extend through and emerge from said passage of a corresponding one of said rim slots, and (b) reconfigurable to lie athwart said passage at a variable position along said fastening member in order to lock said fastening member in said rim slot to an adjustable depth in the rim slot;

a support structure attached to said pair of frames and adapted to extend along said rim toward said front brim; and a lens attached to said support structure.

2. An eye shield attachment according to claim 1 wherein said fastening members are adapted to internally traverse the passage in a given direction, emerge therefrom and extend in a direction opposite said given direction on the outside of a corresponding one of said pair of rim slots.

3. An eye shield attachment according to claim 2 wherein said fastening member is adapted to emerge from said rim slot and arrive back at said frame.

4. An eye shield attachment according to claim 1 wherein said lens is operable to pivot between a lowered and a raised position.

5. An eye shield attachment according to claim 1 wherein said lens is removable from said support structure so that said lens can be replaced.

6. An eye shield attachment according to claim 1 wherein said fastening member comprises:

a band having a plurality of slots.

7. An eye shield attachment according to claim 6 wherein each of said frames has a lug adapted to connect into one of the slots of the band, said band being flexible.

8. An eye shield attachment according to claim 2 comprising:

at least one tong reaching in an extension direction a predetermined distance from said frame and being adapted for insertion into said rim slot, said at least one tong being inwardly compressible in said rim slot.

9. An eye shield attachment according to claim 8 wherein said at least one tong having an outside edge that distally converges, said outside edge being adapted for at least 90% of its length to penetrate said rim slot.

10. An eye shield attachment according to claim 8 wherein said at least one tong comprises:

a pair of posts straddling said fastening member, each of said posts having a distal end; and a pair of cantilevers projecting back at an acute angle from the distal end of a different corresponding one of said posts.

11. An eye shield attachment according to claim 1 comprising:

a pair of rotors rotatably mounted in said frames, said structure being attached to said pair of rotors.

12. An eye shield attachment according to claim 11 wherein said pair of rotors each have teeth, said frames each having an elevational detent for projecting into said teeth.

13. An eye shield attachment according to claim 11 wherein said pair of rotors each have a channel, said structure being slidably mounted in the channels of said pair of rotors.

14. An eye shield attachment according to claim 13 wherein said structure is shaped to limit dorsal movement of said structure in said channels.

15. An eye shield attachment according to claim 13 wherein said support structure has a pair of racks mounted to pass through the channels of said pair of rotors, each of said pair of rotors having a proximity detent for engaging a different corresponding one of said racks.

16. An eye shield attachment according to claim 11 wherein said structure has a pair of tips projecting dorsally from said rotors, said tips having an opening sized to hold a lanyard.

17. An eye shield attachment according to claim 11 wherein said structure has a pair of stops for restricting removal of said structure from said rotors, said structure having a pair of hollows underlying said stops that are at least partially collapsible to allowing retraction of said stops and removal of said structure from said rotors.

18. An eye shield attachment according to claim 1 comprising:

corrective glasses attached to said support structure behind said lens.

19. An eye shield attachment according to claim 18 wherein said support structure comprises:

a front section with a land region, said corrective glasses being adapted to removably clip onto said land region.

20. An eye shield attachment according to claim 1 comprising:

a pliable bead attached to said support structure and extending rearwardly to engage a wearer's forehead.

21. An eye shield attachment according to claim 20 wherein said support structure comprises an arch with a front section integral with a right and left section.

22. A method for attaching an eye shield to a safety helmet having a front brim continuous with a rim extending along each opposite side of said safety helmet to a pair of rim slots in the rim of said safety helmet, the rim slots each having a passage open at either end, the method comprising the steps of:

attaching to said pair of rim slots a support structure that extends along said rim to said front brim by inserting a pair of fastening members into the rim slots to extend into and emerge from the passage, the support structure being used to support the eye shield; and reconfiguring said fastening members to lie athwart said passage at a variable position along said fastening members in order to lock them in place to adjustable depths in the rim slots.

23. A method according to claim 22 wherein the step of using the pair of fastening members is performed by inserting them through said rim slots.

24. A method according to claim 22 wherein the step of using the pair of fastening members is performed by inserting them in a direction away from the support structure through the rim slots before returning the fastening members on the outside of the rim slots in a direction back toward said structure.

25. A method according to claim 24 comprising the step of:

moving said eye shield between a raised and a lowered position on said support structure.

26. A method according to claim 24 wherein the step of returning the fastening members is performed by bringing the fastening members adjacent to said support structure.

27. A method according to claim 24 wherein the step of returning the fastening members is performed by connecting the fastening members to said support structure.

28. A method according to claim 22 comprising the step of:

removing and replacing the eye shield from said support structure.

29. A method according to claim 22 wherein the support structure has on opposite sides at least one tong, the method including the step of:

inserting into said rim slots on each of the opposite sides the at least one tong, allowing compression thereof in order to reduce play.

30. A method according to claim 22 comprising the step of:

limiting dorsal movement of said support structure in order to restrict facial impact by said eye shield.

31. A method according to claim 22 comprising the step of:

adjusting said support structure angularly and linearly to position said eye shield.

32. A method according to claim 31 comprising the step of:

tethering an object at an aft end of said support structure.

33. A method according to claim 32 wherein said support structure has a stop for restricting removal of said structure, the method comprising the steps of:

deforming said structure to retract said stop; and removing at least part of said support structure from said rim slots.

34. A method according to claim 22, the method employing corrective glasses and comprising the step of:

removably attaching the corrective glasses to the support structure behind the eye shield.

35. A method according to claim 22 comprising the step of:

pressing a front section of the support structure against a wearer's forehead to divert sweat.

* * * * *